US007014181B2

(12) United States Patent
Walsh et al.

(10) Patent No.: US 7,014,181 B2
(45) Date of Patent: Mar. 21, 2006

(54) SHEET FOLDOVER APPARATUS

(75) Inventors: James Andrew Walsh, Mason, WI (US); Charles L. Schmidt, V, Mellen, WI (US)

(73) Assignee: C.G. Bretting Manufacturing Company, Inc., Ashland, WI (US)

( * ) Notice: Subject to any disclaimer, the term of this patent is extended or adjusted under 35 U.S.C. 154(b) by 106 days.

(21) Appl. No.: 10/656,833

(22) Filed: Sep. 5, 2003

(65) Prior Publication Data

US 2005/0062209 A1 Mar. 24, 2005

(51) Int. Cl.
*B41L 1/32* (2006.01)

(52) U.S. Cl. ..... 270/52.24; 270/39.06; 493/455; 493/453; 493/446; 493/438

(58) Field of Classification Search ..... 270/52.24, 270/52.23, 39.06; 493/410, 438, 446, 455, 493/453

See application file for complete search history.

(56) References Cited

U.S. PATENT DOCUMENTS 3,207,361 A * 9/1965 Marcalus ..... 221/48
3,561,751 A * 2/1971 Dutro ..... 270/52.24
3,627,302 A * 12/1971 Dutro ..... 270/52.24
4,231,558 A * 11/1980 Aterianus et al. ..... 270/60
4,526,356 A * 7/1985 Swint ..... 270/52.23
4,874,158 A 10/1989 Retzloff
5,299,793 A * 4/1994 Couturier ..... 270/39.06
6,210,309 B1 * 4/2001 Smithe et al. ..... 493/438
6,299,154 B1 * 10/2001 Ballestrazzi et al. ..... 270/52.24

* cited by examiner

*Primary Examiner*—Patrick Mackey
(74) *Attorney, Agent, or Firm*—Michael Best & Friedrich LLP

(57) ABSTRACT

A method and apparatus for folding over a portion of at least one top sheet of a stack of interfolded sheets. The foldover apparatus includes a conveyor adapted to move the stack in the downstream direction, a vacuum assembly adapted to separate at least a portion of the at least one top sheet from the remainder of the stack, and a forming plow to fold over the portion of the at least one top sheet. The method includes moving the stack of sheets downstream along a path, separating the portion of the at least one top sheet from the remaining portion of the stack of interfolded sheets, moving the portion of the at least one top sheet adjacent a forming plow, moving the portion of the at least one top sheet along the folding plow, and folding over the portion of the at least one top sheet.

30 Claims, 6 Drawing Sheets

SHEET FOLDOVER APPARATUS

FIELD OF THE INVENTION

The invention relates to apparatuses and methods for folding over a portion of a sheet in a stack of interfolded sheets to create a dispensing fold.

BACKGROUND OF THE INVENTION

Many stacking devices are used to continuously create stacks of sheet products. In one common stacking device, the sheets are fed from a feeding roll into an interfolder. The interfolder creates a stack of sheets wherein each sheet is interfolded with the next. This process is commonly used when making facial tissue, napkins, or other sheet products where it is desirable to package the products such that when the consumer removes the first sheet from the package, the second sheet will then present itself for removal. To make it easier to remove the first sheet from the package, it is known to create a grasping tab or a dispensing fold from the first sheet to make it easier for the consumer to grasp and remove the first sheet from the package.

However, the dispensing folds created from the first sheet using known methods are often weak, causing the first sheet to tear when the consumer removes it from the package. Thus, a need exists for an apparatus and method for creating a strong dispensing fold such that the consumer can remove the sheets from the package without tearing them. A need also exists for a foldover apparatus that works downstream of the interfolder to increase the running speed of the interfolder and that obtains reliable, consistent foldover results.

SUMMARY OF THE INVENTION

In some embodiments of the present invention, the invention includes a foldover apparatus for use downstream of an interfolding apparatus to receive a stack of interfolded sheets. The foldover apparatus includes a conveyor adapted to support the stack and move the stack of interfolded sheets in the downstream direction. The foldover apparatus also includes a forming plow fixed relative to the conveyor, and a vacuum assembly adapted to separate at least a portion of at least one top sheet of the interfolded stack from the remaining portion of the stack. The vacuum assembly is adapted to release the portion of the at least one top sheet into contact with the forming plow. The portion of the at least one top sheet is folded over by the forming plow as the stack moves in the downstream direction.

In one embodiment, the foldover apparatus includes a perforated belt in communication with the vacuum assembly. In another embodiment, the vacuum assembly has an adjustable vacuum strength. In another embodiment, the forming plow is substantially helical in shape. In another embodiment, the portion of the at least one top sheet includes an edge. In another embodiment, the edge is folded. In another embodiment, the portion of the at least one top sheet includes portions of two top sheets.

The invention also provides a method of folding over a portion of at least one top sheet in an interfolded stack of sheets. The method includes providing a stack of interfolded sheets, moving the stack of sheets downstream along a path, and separating the portion of the at least one top sheet from the remaining portion of the stack of interfolded sheets. The method also includes moving the portion of the at least one top sheet adjacent a forming plow, releasing the portion of the at least one top sheet into contact with the forming plow, moving the portion of the at least one top sheet along the forming plow, and folding over the portion of the at least one top sheet.

In one embodiment, separating the portion of the at least one top sheet includes applying a vacuum to the portion of the at least one top sheet. In another embodiment, separating the portion of the at least one top sheet includes separating a folded edge of the at least one top sheet from the remaining portion of the stack. In another embodiment, releasing the portion of the at least one top sheet includes releasing the portion of the at least one top sheet onto a top surface of the forming plow. In another embodiment, separating the portion of the at least one top sheet includes lifting the portion of the at least one top sheet.

More information and a better understanding of the present invention can be achieved by reference to the following drawings and detailed description.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. In the drawings, wherein like reference numerals indicate like parts.

DETAILED DESCRIPTION

Figure 1:
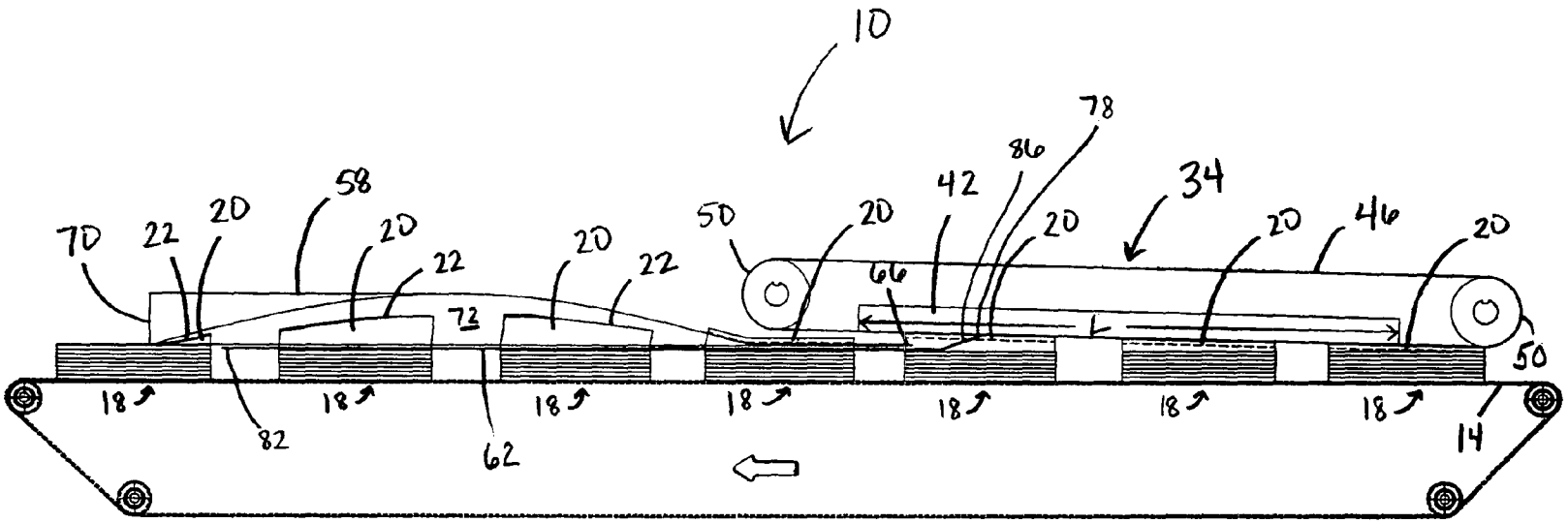
FIG. 1 is a side view of a foldover apparatus according to an embodiment of the present invention.

FIG. 1 illustrates a foldover apparatus 10 embodying features of the present invention. The foldover apparatus 10 includes a conveyor 14 located downstream of an interfolder (not shown). The conveyor 14 receives stacks 18 of interfolded sheets 20 from the interfolder. In some embodiments, such as illustrated in FIG. 1, the conveyor 14 receives discrete stacks 18 of interfolded sheets 20. In other embodiments (not shown, but readily understood by one skilled in the art), the conveyor 14 receives an interfolded log of sheets that can be separated into discrete stacks at some point downstream of the foldover apparatus 10. The conveyor 14 is adapted to move the stack 18 of sheets 20 in the downstream direction, as illustrated by the arrow in FIG. 1. In other embodiments, the conveyor 14 can be a vacuum belt, a high friction belt, a paddle conveyor, or any other suitable devices for moving the stacks 18 in the downstream direction.

Figure 11:
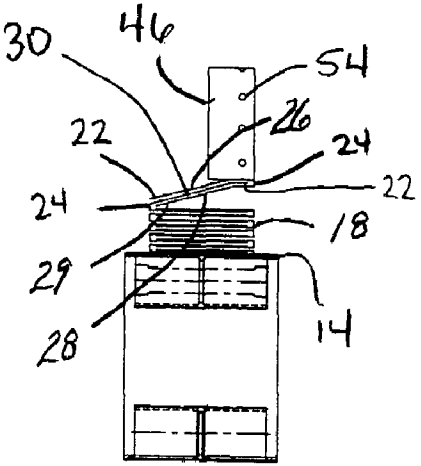
Figure 12:
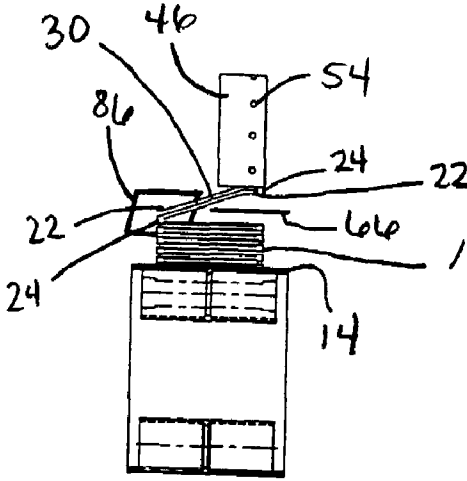
Figure 15:
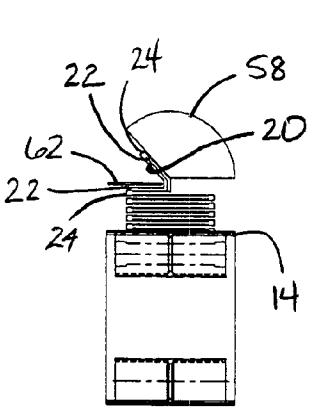
Figure 14:
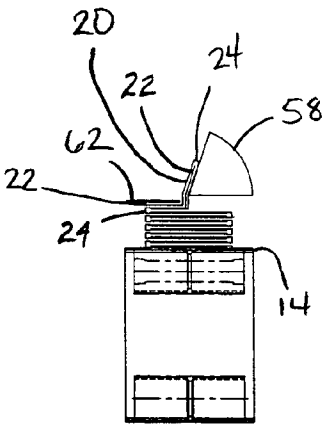
Figure 13:
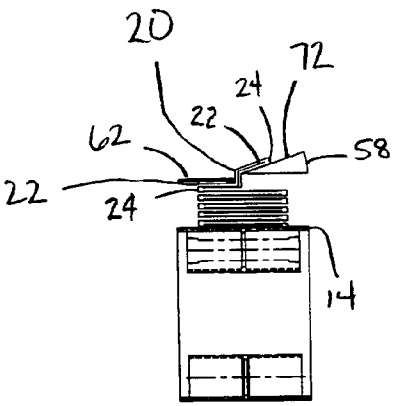

The stack 18 includes a plurality of interfolded sheets 20, each having first and second free edges 22, 29 spaced from a folded edge 24 (FIG. 11). Each sheet 20 also includes a top interfolded portion 26 between the free edge 22 and the folded edge 24 and a bottom interfolded portion 28 between the folded edge 24 and the second free edge 29. The sheets 20 of the stack 18 are arranged such that adjacent sheets 20 are folded within and oriented oppositely to the adjacent sheets 20. More specifically, the stack 18 of sheets 20 is interfolded such that the free edge 22 and top interfolded portion 26 of a sheet 20 are received between the top and bottom interfolded portions 26, 28 of an adjacent sheet 20. Also, the bottom interfolded portion 28 is interfolded such that the second free edge 29 and the bottom interfolded portion 28 are received between the top and bottom interfolded portions 26, 28 of an adjacent sheet 20 in the opposite direction. In most embodiments, the entire stack 18 is arranged in this manner except that the top sheet 20 of the stack 18 will not have its first free edge 22 and top interfolded portion 26 received within an adjacent sheet 20 and the bottom sheet 20 of the stack 18 will not have its second free edge 29 and bottom interfolded portion 28 received within an adjacent sheet 20.

Referring back to FIG. 1, the foldover apparatus 10 includes a vacuum assembly 34 capable of separating at least a portion of the top sheet 20 from the remainder of the stack of sheets 18. As used herein, "separating" the portion of the top sheet 20 from the remainder of the stack 18 means creating a gap between a portion of the top sheet 20 and the remainder of the stack 18, as opposed to completely removing the portion from the top sheet 20 from the stack 18 (such as by ripping or tearing it off).

The vacuum assembly 34 includes a vacuum chamber 42 and a belt 46. The belt 46 moves in the downstream direction around pulleys 50 at the same speed as the conveyor 14. In other embodiments, the speed of the belt 46 moves slightly faster or slightly slower than the conveyor 14. The apparatus 10 can also include a conventional controller (not shown) to ensure that the belt 46 and conveyor 14 run at controlled speeds. In other embodiments, the apparatus 10 can include a timing belt (also not shown) that ensures that the belt 46 and conveyor 14 run at the same speed.

Further, in other embodiments, a vacuum wheel or other vacuum device could be substituted for the vacuum assembly 34. In some embodiments, the upstream pulley 50 compresses the stack 20 against the conveyor 14 as it moves under the pulley 50 in the downstream direction for better control of the stack 18.

Figure 2:
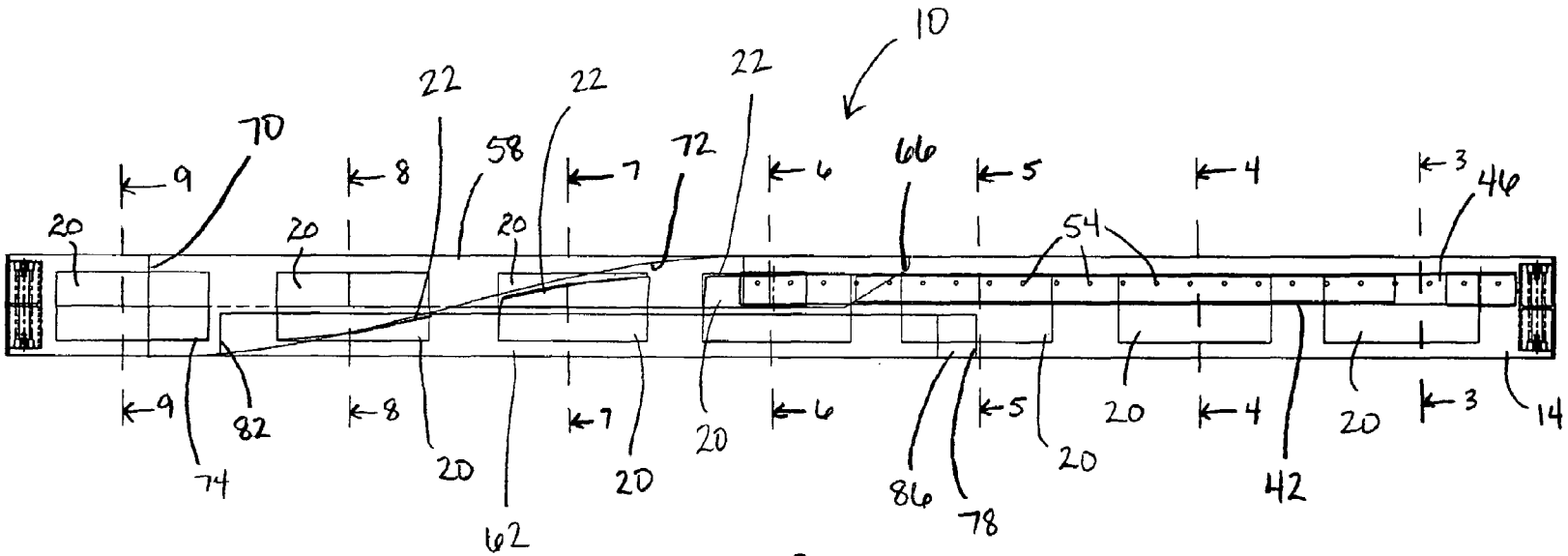
FIG. 2 is a top view of the foldover apparatus of FIG. 1.
Figure 4:
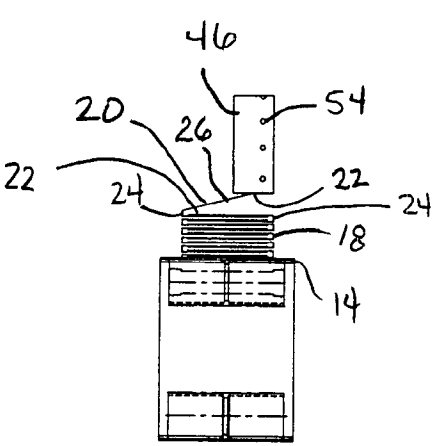
FIGS. 3–9 are cross-section views of FIG. 2 taken along lines 3—3 through 9—9, respectively, illustrating the foldover process.
Figure 3:
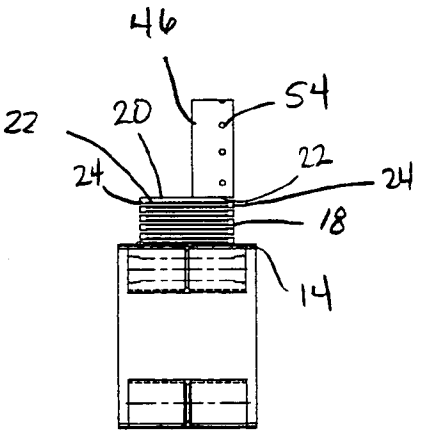

The belt 46 can include perforations 54 (FIG. 2) such that when the perforations 54 travel over the vacuum chamber 42, the vacuum is applied through the perforations 54 in the belt 46 to the stack of interfolded sheets 18. The perforations 54 are positioned in the belt 46 such that the vacuum separates a desired portion of at least the top sheet 20 from the remainder of the stack 18. In the illustrated embodiment, the perforations 54 are evenly sized and spaced apart along one side of the belt 46 (the right side in FIG. 2 when looking at the belt 46 longitudinally from the upstream end). In other embodiments, the perforations 54 can be of any size and can be in any position along the belt appropriate to separate the desired portion of the top sheet 20. Additionally, the perforations 54 can form any pattern along the belt 46 and are not limited to being located along the same side or same portion of the belt 46.

The separated portion of the top sheet 20 can include the free edge 22 of the top sheet 20 (as illustrated in FIGS. 3–9), the folded edge 24 of the top sheet 20 (as illustrated in FIGS. 10–16), or any other desired portion of the top sheet 20, such as an edge 22, 24 and parts of the top interfolded portion 26. In one embodiment, the vacuum applied by the vacuum chamber 42 is adjustable in strength such that the operator of the foldover apparatus 10 can adjust the vacuum to allow the vacuum chamber 42 to grasp one sheet from the stack 18, two sheets, three sheets, or whatever number of sheets is desired by the operator. In other embodiments, the vacuum can have a set strength capable of picking up one desired number of sheets.

The foldover apparatus 10 also includes a forming plow 58 fixed to the apparatus 10 relative to the conveyor 14, and a guide plate 62 also fixed relative to the conveyor 14. The forming plow 58 includes an upstream end 66, a downstream end 70, and a folding surface 72 extending at least partially between the upstream and downstream ends 66, 70. The forming plow 58 is shaped such that contact between the top sheet 20 and the folding surface 72 results in the foldover of the top sheet 20 as the stack of sheets 18 moves downstream to create a dispensing fold 74 (best illustrated in FIGS. 3–9 and 10–16).

The forming plow 58 in the illustrated embodiment is substantially helical in shape. However, in other embodiments, the forming plow could be any shape that results in the folding over of the top sheet 20, such as otherwise curved, angular, etc. With reference to FIGS. 1 and 5–9, the upstream end 66 of the forming plow 58 is relatively thin and flat in cross-section. As the stack of sheets 18 moves downstream, the forming plow 58 increases in width and the folding surface 72 is of a curved, helical shape to create the dispensing fold 74. It is understood that while the forming plow 58 of the illustrated embodiment is substantially solid, the plow could also be formed of two plates (shown in shadow in FIG. 8) such that the plates at least form the folding surface 72. Further, more plates or other structure can be joined together to form the folding surface 72.

Figure 5:
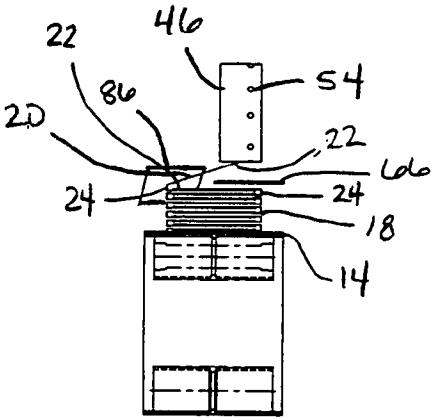

The guide plate 62 also includes an upstream end 78 and a downstream end 82. With reference to FIGS. 1 and 5, the upstream end 78 includes a ramp 86 under which passes the remainder of the stack 18. The ramp 86 assists in separating the top sheet 20 from the remainder of the stack 18 as the stack of interfolded sheets 18 moves in the downstream direction. The "portion of the top sheet" that is separated by the vacuum is the section of the top sheet 20 that is moved by the vacuum and that is not held in position with the remainder of the stack 18 by the guide plate 62. In some embodiments, the guide plate 62 is positioned to slightly compress the remainder of the stack 18 to keep the sheets 20 in the remainder of the stack 18 neatly folded and to ensure a clean fold when creating the dispensing fold 74. However, in other embodiments, the guide plate 62 is positioned such that no compression of the remainder of the stack 18 occurs.

In the illustrated embodiment, the guide plate 62 is of relatively uniform width and height as the stack 18 moves downstream. However, in other embodiments, the guide plate 62 can have an inverse helical shape that is opposite in downstream image to the forming plow 58 (shown in shadow in FIGS. 6–8), forming a channel 90 between the forming plow 58 and the guide plate 62 through which the portion of the top sheet 20 to be folded passes, or any other shape that cooperates with the shape of the forming plow 58. It is also understood that the guide plate 62 can vary in height in the downstream direction such that the remainder of the stack 18 is more compressed at one or more locations near the downstream end 82 of the guide plate 62 than near the upstream end 78. Further, while the illustrated embodiment includes a continuous guide plate 62, in other embodiments the guide plate 62 can be a plurality of guide plates 42 separated by some distance, a separate conveyor or belt, a plurality of fingers, or any other suitable means to guide the remainder of the stack 18 as the stack of sheets 18 moves downstream.

Further, in other embodiments, the positions of the conveyor 14, the belt 46, the plow 58, and the plate 62 with respect to each other can vary and still fall within the scope of the invention. For example, the position of the belt 46, plow 58, and/or guide plate 62 can be adjustable with respect to the conveyor 14 to allow for the processing of stacks 18 of varying heights (i.e., having varying numbers of sheets 20 in the stack 18). Conversely, the position of the conveyor 14 can also be adjustable. The belt 46, plow 58, and/or guide plate 62 can also be axially movable to change the portion of the top sheet 20 that is separated from the remainder of the stack 18 and folded.

It is also understood that the longitudinal length L of the vacuum chamber 42 can be changed relative to the upstream ends 66, 78 of the plow 58 and guide plate 62, respectively. The vacuum chamber 42 need only have a length sufficient to separate the desired portion of the top sheet 20 from the remainder of the stack 18 before the stack 18 reaches the upstream ends 66, 78 of the plow 58 and guide plate 62.

FIGS. 3–9 best illustrate the path of the stack 18 as it travels down the conveyor 14. Beginning with FIG. 3, the stack 18 is received by the conveyor 14 from the interfolder. The perforations 54 are positioned to separate the free edge 22 of the top sheet 20 from the remainder of the stack of sheets 18. As used herein, separating the free edge 22 should not be limited to separation of the edge 22 alone, but rather should be interpreted to include the free edge 22 and any portions of the top interfolded portion 26 extending from the free edge 22 also separated from the stack 18. As the stack 18 moves downstream under the vacuum chamber 42, a vacuum is applied to the free edge 22 of the top sheet 20 to grab the free edge 22 and maintain the free edge 22 relative to the moving belt 46. As the belt 46 moves downstream with the free edge 22, the free edge 22 is separated from the remainder of the stack 18 (see FIGS. 4 and 5). In other embodiments, the free edge 22 can be separated from the remainder of the stack 18 by a finger, a ramp, an adhesive portion of the belt, or any other means suitable to separate the free edge 22 from the remainder of the stack 18.

In the illustrated embodiment, the free edge 22 is separated from the remainder of the stack by lifting the free edge 22 upwardly from the remainder of the stack 18 with the vacuum. In other embodiments, the orientation of the stack could differ such that the free edge 22 can be separated from the remainder of the stack 18 by peeling the free edge 22 off of a sidelying stack in a direction lateral to the remainder of the stack 18, or in any other direction and orientation that results in separating the free edge 22 from the remainder of the stack 18.

Figures 6, 7, 8, 9:
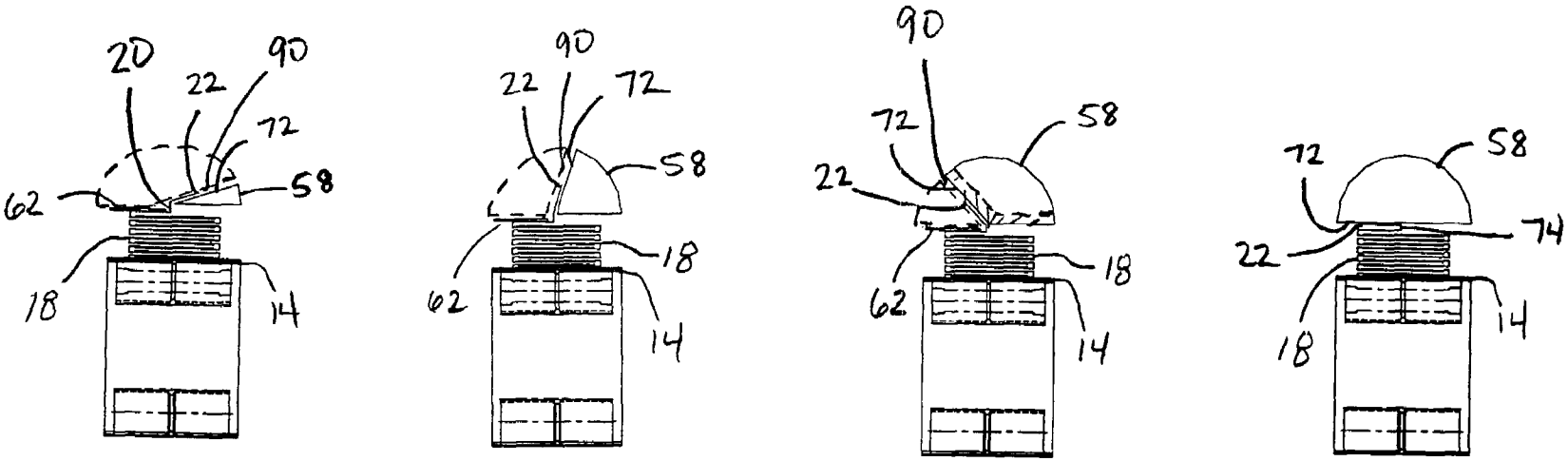
Figure 10:
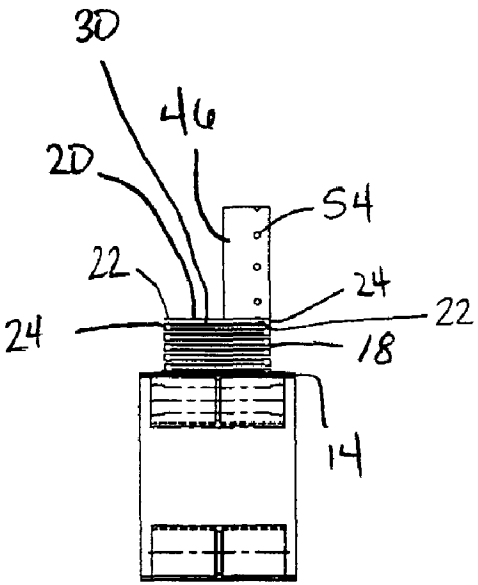
FIGS. 10–16 are cross-section views similar to those shown in FIGS. 3–9, illustrating the foldover of the folded edge of a top sheet of the stack of interfolded sheets.

As illustrated in FIG. 5, in some embodiments, the belt 46 travels in a slightly inclined path relative to the path of the conveyor 22 such that the vacuum moves the free edge 22 along the same inclined path. As the belt 46 travels upwardly, the free edge 22 is lifted and moved adjacent the forming plow 58. As shown in FIGS. 5 and 6, in the illustrated embodiment, the free edge 22 is lifted over the forming plow 58 and is released onto the top surface of the forming plow 58. However, in other embodiments, the free edge 22 can be moved into any position adjacent the forming plow 58. For example, the free edge 22 can be moved along the side of the forming plow or adjacent the underside of the forming plow 58. The adjacent position in any given embodiment is determined by the shape of the forming plow 58 and the path along the forming plow 58 that the free edge 22 will follow. In other words, any orientation of the stack of sheets 18 can be used without departing from some embodiments of the invention, as long as the free edge 22 is released when the forming plow 58 is positioned between the free edge 22 and the remainder of the stack 18.

Referring to FIGS. 6–9, as the free edge 22 moves along the forming plow 58, the free edge 22 is folded over to form the dispensing fold 74. As the stack 18 moves in the downstream direction, the folding motion and downstream movement creates a bias to maintain the portion of the top sheet 20 against the folding surface 72 of the forming plow 58. The guide plate 62 rides above the remainder of the stack 18 and applies downward pressure to the remainder of the stack 42 to assist in the foldover process. As shown in FIG. 9, the resulting dispensing fold 74 is two sheets thick (i.e., a single sheet thickness folded over onto itself). In the illustrated embodiment, the free edge 22 follows a substantially helical path as it follows the forming plow 58. However, the free edge 22 can follow any suitable path that results in the folding over of the free edge 22. As the stack 18 moves out from under the forming plow 58, the downstream end 70 compresses the stack 18, preventing separation of the stack 18 as the stack 18 moves out of the foldover apparatus 10, and increasing the integrity of the fold. However, in other embodiments, the forming plow 58 can be positioned such that the stack 18 is not compressed as the stack 18 exits the foldover apparatus 10.

FIGS. 10–16 illustrate another embodiment of the present invention. The positions in FIGS. 10–16 correspond to the positions described above with respect to FIGS. 3–9 and thus will not be described in detail again. However, FIGS. 10–16 illustrate that in some embodiments, the foldover apparatus 10 is designed to fold over the folded edge 24 of the stack of interfolded sheets 18. By separating the folded edge 24, portions of the top and bottom interfolded portions 26, 28 extending from the folded edge 24 are also separated from the remainder of the stack 18. Separating the folded edge 24 also results in the separation of the free edge 22 of the adjacent sheet 20 along with a portion of the top interfolded portion 26 extending from the free edge 22 as well, due to the interfolding of the sheets 20. The vacuum strength is thus adjusted such that the vacuum is capable of lifting the folded edge 24 of the top sheet 20 and the free edge 22 of the adjacent sheet 20 from the remainder of the stack 18.

Figure 16:
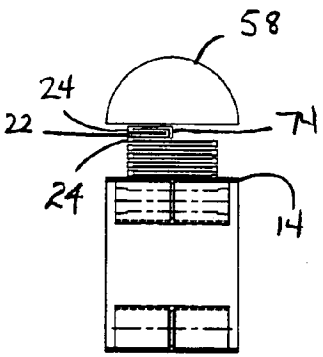

Referring to FIGS. 13–16, the folded edge 24 travels downstream along the forming plow 58 to form the dispensing fold 74 that is six sheets thick (i.e., three sheet thickness folded over onto itself—see FIG. 16). Thus, folding over the folded edge 24 results in a thicker, stronger dispensing fold 74*a*.

Various features of the invention are found in the following claims.

We claim:

1. A foldover apparatus for use downstream of an interfolding apparatus to receive a stack of interfolded sheets, the foldover apparatus comprising:

a conveyor adapted to support the stack and move the stack of interfolded sheets in the downstream direction through a stack path;

a forming plow fixed relative to the conveyor, the forming plow being curved in the downstream direction along the stack path; and a vacuum assembly adapted to separate at least a portion of at least one top sheet of the interfolded stack from the remaining portion of the stack, and adapted to release the portion of the at least one top sheet into contact with the forming plow, the portion of the at least one top sheet being folded over by the forming plow as the stack moves in the downstream direction;

wherein the vacuum assembly has a first vacuum strength that is greater than zero, and a second vacuum strength that is greater than the first vacuum strength such that the vacuum strength of the vacuum assembly is adjustable to one of the first and second vacuum strengths.

2. The foldover apparatus of claim 1, further comprising a perforated belt in communication with the vacuum assembly.

3. The foldover apparatus of claim 2, wherein the belt is inclined relative to the conveyor.

4. The foldover apparatus of claim 1, wherein the vacuum assembly includes a vacuum chamber.

5. The foldover apparatus of claim 1, wherein the conveyor includes a guide plate.

6. The foldover apparatus of claim 1, wherein the forming plow is substantially helical in shape.

7. The foldover apparatus of claim 1, wherein the portion of at least one top sheet of the interfolded stack includes an edge of the at least one top sheet.

8. The foldover apparatus of claim 7, wherein the edge of the at least one top sheet is the folded edge.

9. The foldover apparatus of claim 1, wherein the portion of at least one top sheet includes portions of two top sheets.

10. A foldover apparatus for use downstream of an interfolding apparatus to receive a stack of interfolded sheets, the foldover apparatus comprising:

a conveyor adapted to support the stack and to move the stack of interfolded sheets in the downstream direction;

a vacuum assembly adapted to separate a portion of at least one top sheet of the interfolded stack from the remaining portion of the stack and move the portion of the at least one top sheet in the downstream direction; and a forming plow extending along a portion of one of the conveyor and the vacuum assembly, the vacuum assembly configured to move the portion of the at least one top sheet on one side of the forming plow and the conveyor configured to move the remaining portion of the stack on the opposite side of the forming plow such that continued downstream motion of at least one of the vacuum assembly and the conveyor causes the portion of the at least one top sheet to be folded over by the folding plow, the one side of the forming plow being curved in the downstream direction;

wherein the vacuum assembly has a first vacuum strength that is greater than zero, and a second vacuum strength that is greater than the first vacuum strength such that the vacuum strength of the vacuum assembly is adjustable to one of the first and second vacuum strengths.

11. The foldover apparatus of claim 10, wherein the vacuum assembly includes a vacuum chamber.

12. The foldover apparatus of claim 10, further comprising a perforated belt coupled to the vacuum assembly.

13. The foldover apparatus of claim 12, wherein the perforations on the belt are positioned to lift a desired portion of the at least one top sheet.

14. The foldover apparatus of claim 13, wherein the desired portion of the at least one top sheet is the folded edge of the at least one top sheet.

15. The foldover apparatus of claim 12, wherein the belt is inclined relative to the conveyor.

16. The foldover apparatus of claim 10, wherein the forming plow is substantially helical in shape.

17. The foldover apparatus of claim 10, wherein the portion of the at least one top sheet includes portions of two sheets.

18. A method of folding over a portion of at least one top sheet in an interfolded stack of sheets, the method comprising:

providing a stack of interfolded sheets;

moving the stack of sheets downstream along a path;

separating the portion of the at least one top sheet from the remaining portion of the stack of interfolded sheets by applying a vacuum to the portion of the at least one top sheet, the portion of the at least one top sheet including a folded edge of the at least one top sheet;

moving the portion of the at least one top sheet adjacent a forming plow;

releasing the portion of the at least one top sheet into contact with the forming plow;

moving the portion of the at least one top sheet along the forming plow; and folding over the portion of the at least one top sheet;

wherein separating the portion of the at least one top sheet includes lifting the folded edge from the remaining portion of the stack such that the folded edge is lifted to a position higher than a free edge of the at least one top sheet, and wherein applying a vacuum to the portion of the at least one top sheet includes applying a vacuum having a first vacuum strength that is greater than zero, and a second vacuum strength that is greater than the first vacuum strength such that the vacuum strength of the vacuum assembly is adjustable to one of the first and second vacuum strengths.

19. The method of claim 18, wherein separating the portion of the at least one top sheet from the remaining portion of the stack of interfolded sheets includes moving the portion of the at least one top sheet along an inclined path.

20. The method of claim 18, wherein releasing the portion of the at least one top sheet into contact with the forming plow includes releasing the portion of the at least one top sheet onto the forming plow.

21. The method of claim 18, wherein moving the portion of the at least one top sheet along the forming plow includes moving the portion of the at least one top sheet along a substantially helical path.

22. A method of folding over a portion of at least two top sheets that are interfolded together in an interfolded stack of sheets, the method comprising:

providing a stack of interfolded sheets;

moving the stack of sheets downstream along a path;

separating the portion of the at least two top sheets that are interfolded together from the remaining portion of the stack of interfolded sheets by applying a vacuum to the portion of the at least two top sheets, the at least two top sheets folded within and oriented oppositely to each other;

moving the portion of the at least two top sheets adjacent a forming plow;

releasing the portion of the at least two top sheets into contact with the forming plow;

moving the portion of the at least two top sheets along the forming plow; and folding over the portion of the at least two top sheets;

wherein applying a vacuum to the portion of the at least two top sheets includes applying a vacuum having a first vacuum strength that is greater than zero, and a second vacuum strength that is greater than the first vacuum strength such that the vacuum strength of the vacuum assembly is adjustable to one of the first and second vacuum strengths.

23. The method of claim 22, wherein separating the portion of the at least two top sheets includes separating a folded edge of the at least two top sheets from the remaining portion of the stack.

24. The method of claim 22, wherein separating the portion of the at least two top sheets from the remaining portion of the stack of interfolded sheets includes moving the portion of the at least two top sheets along an inclined path.

25. The method of claim 22, wherein releasing the portion of the at least two top sheets into contact with the forming plow includes releasing the portion of the at least two top sheets onto the forming plow.

26. The method of claim 22, wherein moving the portion of the at least two top sheets along the forming plow includes moving the portion of the at least two top sheets along a substantially helical path.

27. A method of folding over a portion of at least one top sheet in an interfolded stack of sheets, the method comprising:

providing a stack of interfolded sheets;

moving the stack of sheets downstream along a path;

separating a portion of at least one top sheet from the remaining portion of the stack of interfolded sheets by applying a vacuum to the portion of the at least one top sheet, the portion of the at least one top sheet including a folded edge;

moving the portion of the at least one top sheet in the downstream direction on a first side of a forming plow;

moving the remaining portion of the stack of interfolded sheets in the downstream direction to a second, opposite side of the forming plow;

releasing the portion of the at least one top sheet on the first side of the forming plow;

moving the portion of the at least one top sheet along the forming plow; and folding over the portion of the at least one top sheet;

wherein separating a portion of the at least one top sheet includes lifting the folded edge from the remaining portion of the stack such that the folded edge is lifted to a position higher than a free edge of the at least one top sheet, and wherein applying a vacuum to the portion of the at least one top sheet includes applying a vacuum having a first vacuum strength that is greater than zero, and a second vacuum strength that is greater than the first vacuum strength such that the vacuum strength of the vacuum assembly is adjustable to one of the first and second vacuum strengths.

28. The method of claim 27, wherein separating the portion of the at least one top sheet includes separating a portion of at least two top sheets.

29. The method of claim 27, wherein releasing the portion of the at least one top sheet onto the forming plow includes releasing the portion of the at least one top surface of the forming plow.

30. The method of claim 27, wherein moving the portion of the at least one top sheet along the forming plow includes moving the portion of the at least one top sheet along a substantially helical path.

* * * * *